US006558031B2

(12) United States Patent
Tiesler-Wittig

(10) Patent No.: US 6,558,031 B2
(45) Date of Patent: May 6, 2003

(54) LIGHTING SYSTEM, IN PARTICULAR FOR MOTOR VEHICLES, AND METHOD OF GENERATING A LIGHT BEAM OF DESIRED SHAPE

(75) Inventor: Helmut Tiesler-Wittig, Ota-Ku (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/040,179

(22) Filed: Oct. 23, 2001

(65) Prior Publication Data

US 2002/0085384 A1 Jul. 4, 2002

(30) Foreign Application Priority Data

Oct. 26, 2000 (DE) ..... 100 53 098

(51) Int. Cl.[7] ..... F21V 9/00

(52) U.S. Cl. ..... 362/511; 362/557; 362/26; 362/268; 359/618; 359/619; 359/620; 313/488; 313/571

(58) Field of Search ..... 362/511, 551, 362/26, 268; 359/618, 619, 620; 313/488, 571

(56) References Cited

U.S. PATENT DOCUMENTS 5,059,860 A * 10/1991 Sato et al. ..... 313/488
5,897,201 A * 4/1999 Simon ..... 362/268

* cited by examiner

*Primary Examiner*—Sandra O'Shea
*Assistant Examiner*—Mark Tsidulko
(74) *Attorney, Agent, or Firm*—Frank Keegan

(57) ABSTRACT

In a lighting system for motor vehicles, light from a HID or MPXL lamp is collected by a collector which surrounds the light source at least partly and is guided further to a separator of optical waveguide material, which separator forms a desired light beam via a specially shaped light outlet surface so as to obtain as high as possible a light output.

11 Claims, 5 Drawing Sheets

Figure 1:
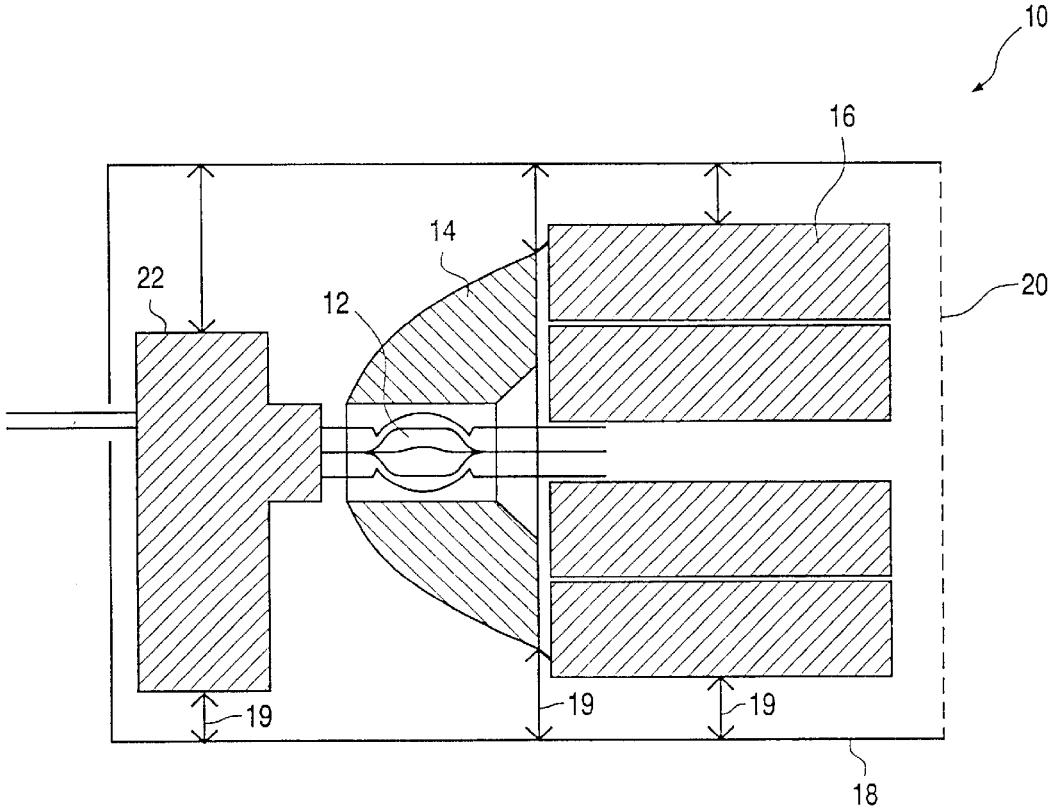

LIGHTING SYSTEM, IN PARTICULAR FOR MOTOR VEHICLES, AND METHOD OF GENERATING A LIGHT BEAM OF DESIRED SHAPE

The invention relates to a lighting system, in particular for motor vehicles, and to a method of generating a light beam of desired shape.

Lighting systems and associated methods of generating light beams have been known for a long time in a wide variety of shapes. It is common to all relevant lighting systems and methods that light is generated by means of a light source, which light is then shaped into a beam by various optical means, such that the light beam of desired shape is obtained. Light sources particularly widely used in the field of motor vehicles are halogen incandescent lamps, and in recent years increasingly gas discharge lamps, more in particular low-voltage gas discharge lamps such as, for example, so-called MPX lamps (Micro Power Xenon lights). The discharge lamps do indeed have major advantages over incandescent lamps as regards their useful life and power dissipation, but the light arc generated thereby has no exact demarcation, in contrast to a coil of an incandescent lamp, and is accordingly optically and photometrically more difficult to control.

To form the desired light beam from the light generated by the light source, first of all parabolic reflectors are known, which project the light source directly onto the surface to be illuminated, i.e. onto the road surface in the case of motor vehicles. The final beam composition is achieved by means of a divergent lens, usually a combination of prismatic and cylindrical lens arrays, which closes off the lighting system at the front. In addition, projection systems are known in which an elliptical reflector pictures the light source at a distance of a few centimeters in front of the lamp. A metal plate is present adjacent this plane in motor vehicle headlights as a mechanical cut-off diaphragm of special shape so as to generate a light-dark edge necessary for a passing beam. A projection lens images this cut-off and the light source on the road surface. Very high-contrast light-dark edges can be generated by this principle of beam generation, but they do show a clear color edging effect.

An improvement of the beam properties is achieved through the use of so-called complex-shape or profiled reflectors. The geometry of the reflector is calculated in small segments with a view to their effect on the headlight beam. A reflector geometry is created thereby which differs from classical rotational (elliptical or parabolic) surfaces. It is possible with complex-shape reflectors in headlights containing halogen incandescent lamps to achieve a sufficiently high contrast at the light-dark edge without a screen cap. A dispersing front lens for influencing the beam can be dispensed with thanks to the improved reflector geometry in the case of such reflectors. A clear cover disc suffices in this case.

High requirements are imposed on the positioning of the light source in the reflector in the known lighting systems with wide-aperture reflectors, which collect the light from the light source and thus build up the headlight beam. This is particularly apparent with the use of gas discharge lamps as the light source, because the light arc does not have sharp boundaries, in contrast to the coil of incandescent lamps.

Increasingly stringent requirements imposed on the beam quality also imply increasingly stringent requirements on the positioning of the light source in the reflector. Since this light source should as a rule be supported so as to be exchangeable, the exact positioning poses a problem. On the one hand, the lamps should be capable of exchange in a simple and fast manner, while on the other hand they must be securely and accurately fastened, and it must be possible to manufacture the fastening devices in use at an affordable cost. This has the result that manufacturing tolerances of the fastening devices used limit the effectivity and the light power of the entire system.

In view of the above, it is an object of the invention to provide a lighting system, in particular for motor vehicles, and a method of generating a light beam of desired shape wherein the exact positioning of the light source relative to the other optical components only has a minor influence on the light output and the efficiency of the entire system, and on the generation of the desired light beam.

This object is achieved by means of a lighting system, in particular for motor vehicles, which comprises at least one light source, preferably in the form of a high-power discharge lamp (HID lamp: High Intensity Discharge lamp), in particular a low-voltage xenon lamp (MPXL: Micro Power Xenon Light), a collector which surrounds the light source at least partly for collecting and passing on the light generated by the light source to at least one separator, and at least one separator of optical waveguide material, while each separator comprises at least one specially shaped light outlet surface for radiating the light, which was guided into the separator, as a light beam of defined shape.

The arrangement according to the invention has a considerable number of advantages. Thus it is made possible to generate the clearly defined light-dark edge required, for example, for the passing beam in the field of motor vehicles through a suitable construction of the collector without absorption and to image this edge by means of one or preferably several separators. Until now, by contrast, the edge was generated by means of cut-off diaphragms, which block out part of the generated light and thus reduce the efficiency of relevant lighting systems unnecessarily. In a lighting system according to the invention, however, practically the entire quantity of light generated by the light source(s) can be utilized for illumination, so that a very high efficiency is achieved.

A further major advantage of the arrangement according to the invention is that very compact lighting systems can be realized thereby, whose constructional dimensions are strongly reduced in comparison with conventional systems.

In a particularly preferred embodiment, the light source, the collector, and the separator(s) are arranged such that a so-called interwoven radiation path is obtained. For this purpose, the separator(s) and the collector are arranged relative to one another such that part of the image of the light source generated by the collector lies within the range of the entrance pupil of each separator. A separation of the lighting beam path (of the image of the light source) and imaging beam path (of the image of the object to be imaged, i.e. the collector in this case) is advantageously achieved in this manner, so that the light outlet surface(s) thereof can generate sharp light-dark edges.

If the light-dark edge lies adjacent or in a pupil of the lighting beam path, an inaccurate alignment of the light source will not or substantially not affect the contrast of the light-dark edge. According to the invention, the collector, with sharp edges regarded as the object lying in its emission surface, takes over the function of the known condenser lenses or the optical lighting system.

In particular, the size of the light source in this arrangement has practically no influence on the aperture in the headlight beam, but only on the diameter of the separators. By contrast, the light source is directly imaged onto the road surface in headlights for motor vehicles presently on the market, i.e. each segment of the reflector generates a sharp picture of the incandescent coil or the light arc on the road surface.

If the diameter of the separators is greater than or at least equal to the size of the virtual light source image, the radiation beam is not cut off, and the efficiency of the lighting system will be very high.

The dissociation of the shape of the radiated light beam from the size and alignment of the incandescent coil renders it possible to keep the aperture of the light beams originating from the light source small without the usual photometric problems, a small aperture being desired as a rule because the constructional dimensions of the collector are directly dependent on this aperture if the collector is to operate with a very high efficiency. Light sources with an aperture of less than 60°, preferably between 20° and 40° and even lower, may be used.

The interwoven beam path furthermore leads to an increase in the efficiency also with the use of conventional discharge lamps, because light can now also be utilized which is scattered in the so-called salt reservoir formed during operation of such discharge lamps. The interwoven beam path means that the arc need no longer be sharply pictured into the headlight beam, so that a stronger scattering of the light only has a minor influence on the beam.

If a discharge lamp with a lamp bulb is to be used as the light source, discharge lamps with a cylindrical or sagged bulb shape were found to be particularly suitable.

The collector is preferably constructed as a solid component and is formed by a transparent, heat-resistant material, preferably glass. Depending on which light source is used, the collector may alternatively be formed from a synthetic resin with optical waveguide properties, which may have advantages as regards weight compared with glass. The great heat arising with the use of conventional gas discharge lamps, however, implies that only few synthetic resins are suitable as collector materials.

The collector preferably has an annular light outlet surface, so that advantageously many applications can be served with one and the same "standardized" collector shape through the use of different separators.

Depending on the shape of the desired light beam and the application, it may suffice to arrange only one separator behind the collector. It was found to be particularly suitable, however, especially for generating the light beam desired for the passing beam in the field of motor vehicles, to distribute the light from the collector over several, preferably six to ten separators, and then to superimpose the light beams radiated by the separators so as to form the light beam of desired shape.

If scattering of the light issuing from the separator(s) is desired, the light outlet surfaces of the separators may for this purpose have a structure similar to that of a dispersing lens. This has the advantage that a separate dispersing lens, and accordingly a further material-air-material transition of the light, which is always accompanied by light losses, can be omitted.

Figure 2:
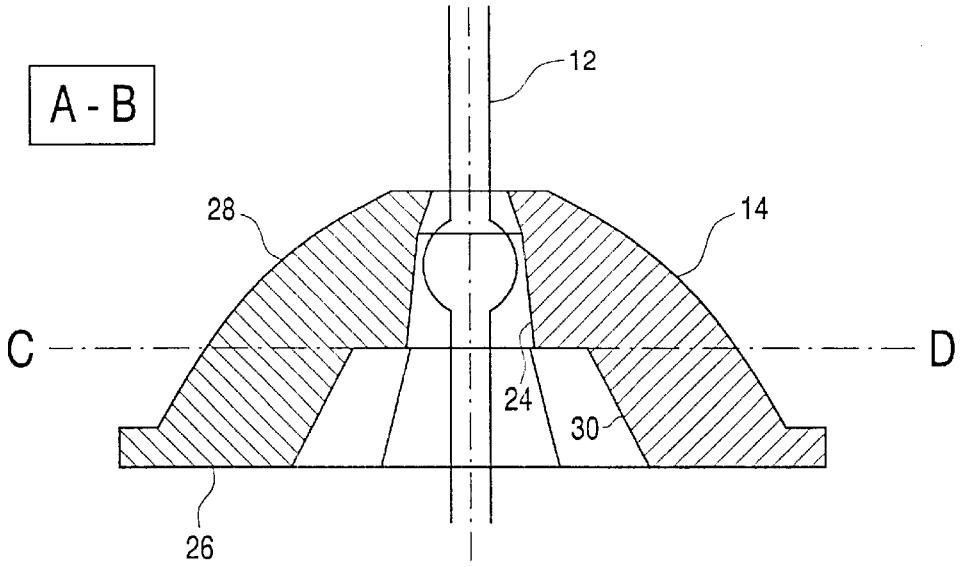
Figure 3:
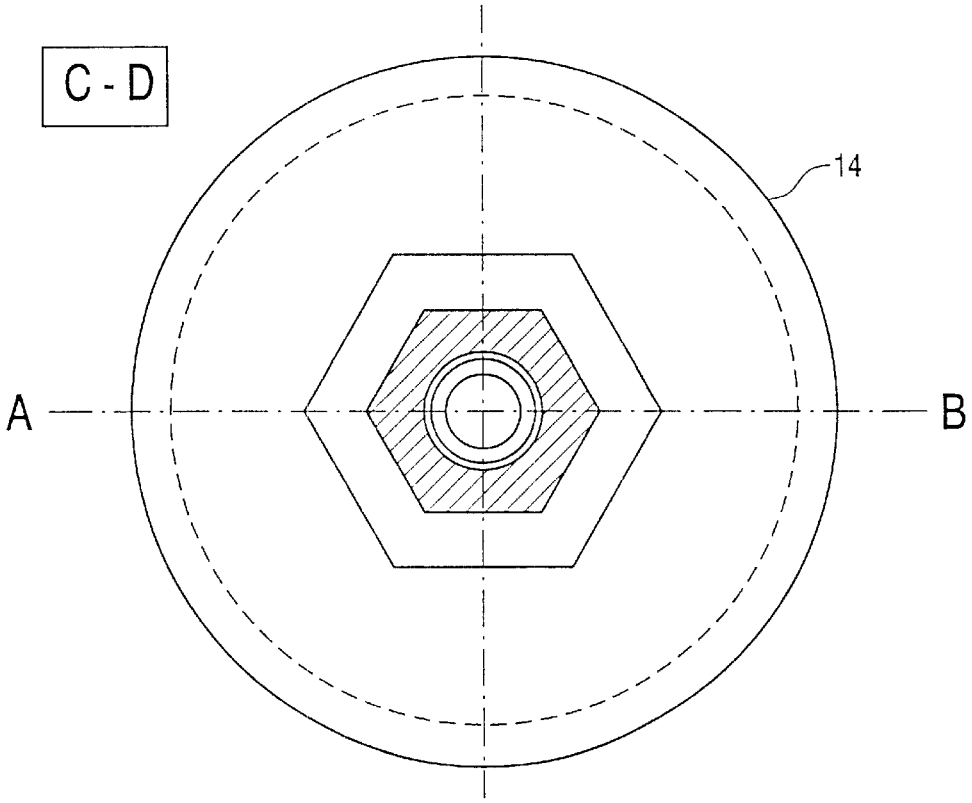
Figure 4:
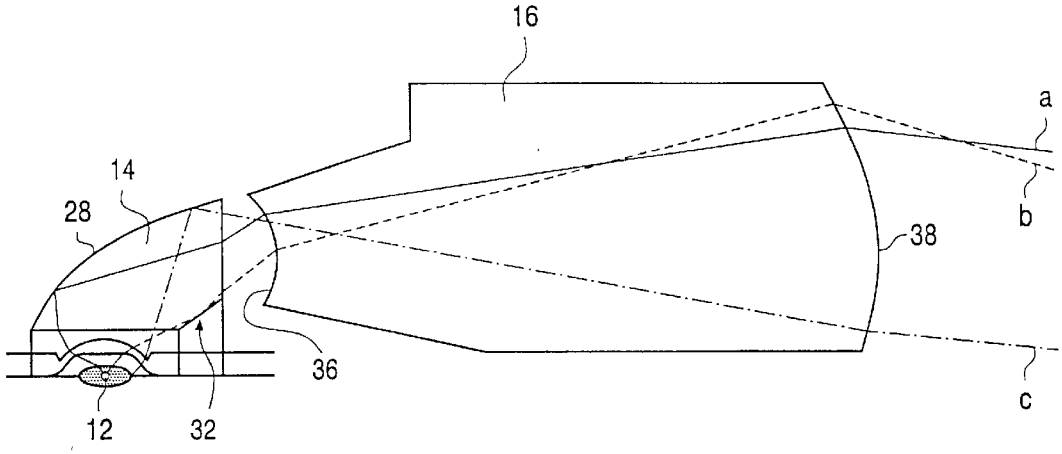
Figure 5:
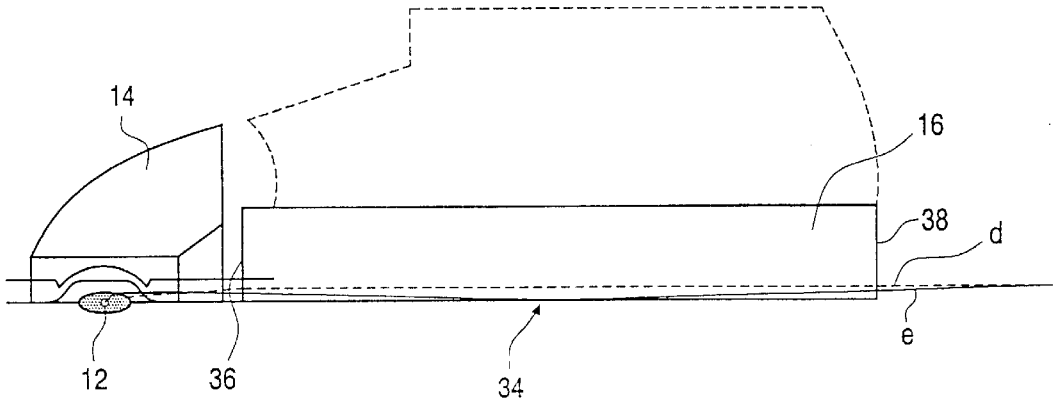
Figure 6:
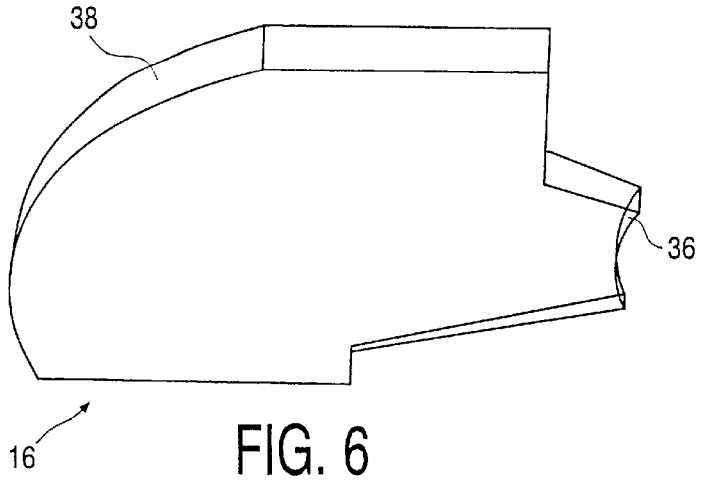
Figure 7:
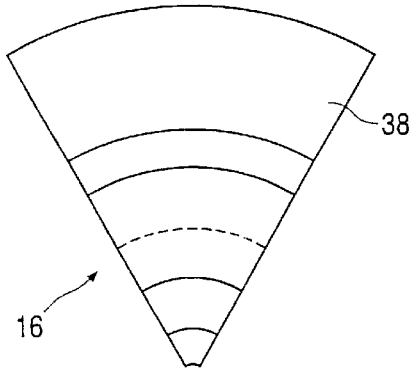
Figure 8:
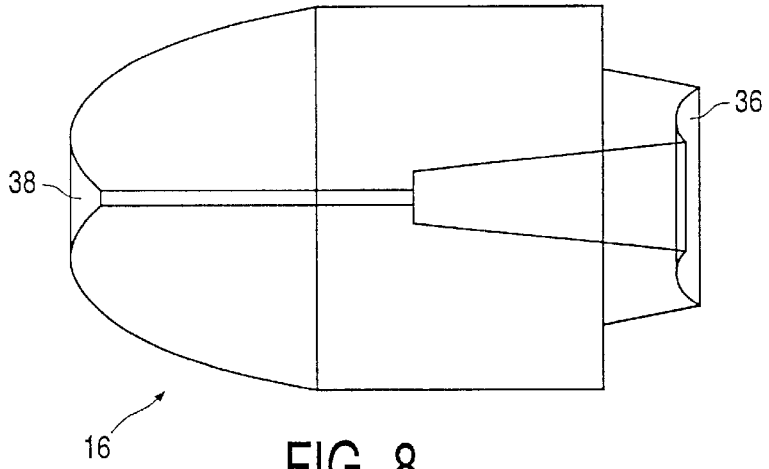
Figure 9:
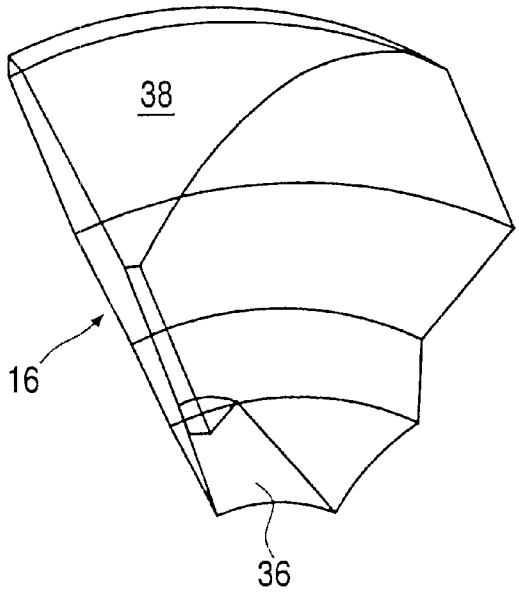
Figure 10:
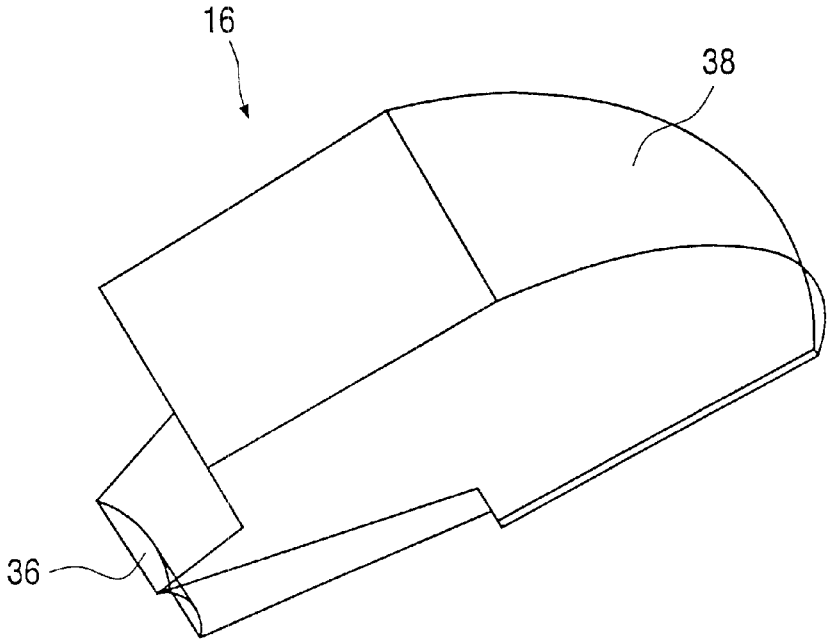

Further particulars and advantages of the invention will become apparent from the ensuing description of an embodiment, which is given purely by way of example and to which the invention is by no means limited, with reference to the drawing, in which:

FIG. 1 is a diagram showing the principle of a lighting system with a light source, a collector, and separators arranged in a housing, FIG. 2 is a cross-sectional view of the collector of FIG. 1 taken on the line A–B in FIG. 3, FIG. 3 is a cross-sectional view of the collector taken on the line C–D in FIG. 2, FIG. 4 is a diagram showing the principle of the interwoven radiation path through a lighting system according to the invention with a light source, a collector, and a separator shown in side elevation, FIG. 5 shows the radiation path through the lighting system of FIG. 4 viewed in an elevation rotated through 90° about the main radiation direction as compared with FIG. 4, and FIGS. 6 to 10 are various elevations of a separator constructed in accordance with the invention.

FIG. 1 shows a lighting system, referenced 10 in its totality, whose essential components are a light source in the form of a discharge lamp 12, a collector 14, and a number of separators 16 jointly forming a collective separator, arranged in a common housing 18 with a light-transmitting front 20. The components and a ballast 20 necessary for operating the discharge lamp 12 are retained in the housing 18 by known, respective retention means 24 in a suitable, possibly adjustable manner.

The collector 14 and the separators 16 are solid components, which means that the guiding of the light and the formation of a light beam takes place inside transparent materials, in contrast to conventional systems, and that the light moves from the light source to the exit from the lighting system substantially not in air, but in a solid medium.

The collector 14 is shown in two elevations in FIGS. 2 and 3. An essential feature of the invention can be clearly observed, which feature contributes to the high efficiency of a lighting system according to the invention: the collector "embraces" the discharge lamp 12, or more exactly that region in which the electrodes of the discharge lamp are positioned and in which the light arc is formed during operation of the lamp. The collector thus captures substantially all the generated light. For this purpose, a light inlet surface 24 of the collector is constructed such that it surrounds the discharge lamp 12 and that its axial boundary lies outside the region occupied by the bulb of the discharge lamp 12.

In the embodiment shown, the discharge lamp 12 is positioned relative to the collector 14 such that the electrodes of the lamp lie on a straight line which extends substantially parallel to the radiation direction of the desired light beam. This is accordingly denoted an "axial burner position", as opposed to a so-called "transverse burner position", in which part of the light generated by the burner is directly radiated in the direction of the desired light beam.

In the transverse burner position, part of the light must be conducted via a reflecting surface so as to be guided in the desired direction. The formation of a light beam from the resulting mixture of directly radiated and reflected light, however, is difficult to implement and requires an exact, and thus very laborious alignment of the burner relative to the reflector or collector. The axial burner position shown here will accordingly be preferable in general.

In the axial burner position, no light is radiated in the direction of the desired light beam to be generated by the lighting system, so that all the light is to be influenced by the collector in order to be guided in the beam direction. This renders it easier to obtain a desired output light distribution of the collector.

The collector 14 in this embodiment has a radial aperture of between approximately 15° and 25° and comprises a conical light inlet surface 24 facing the light source and an annular light outlet surface 26. A rotationally symmetrical construction of the collector 14 advantageously renders it possible to generate different light beams with one and the same collector, for example, when used in a motor vehicle headlight, a beam for right-hand traffic and for left-hand traffic. This renders possible a particularly economical manufacture of various headlight models based on the same collector. It is only the separators which have to be interchanged then.

It may be useful, depending on the shape of the collector, to reflectorize the outside 28 of the collector 14 at least partly so as to ensure that light radiated by the lamp 12 through the light inlet surface into the collector 14 is substantially fully guided to the light outlet surface 26. The reflectorized outside 28 of the collector 14 has the shape of a rotational ellipsoid.

In principle, the collector may alternatively be shaped such that the desired reflection is also achieved at the outside through total reflection, but the at least partial reflectorizing of the outside leads to a particularly compact construction of the collector and thus to a short constructional dimension of the entire system.

The light outlet surface 26 of the collector is shaped such that the light beams issuing from the light outlet surface 26 during normal operation of the lighting system have sharp light-dark transitions. These are then imaged by means of the separators, so that a light beam of the desired shape is obtained through superimposition.

The inside 30 of the collector is shaped such that it is capable of total reflection when the collector is correctly mounted with respect to the light source. The radiation path is shown in FIGS. 4 and 5.

FIGS. 4 and 5 show the paths of light rays a, b, c, d, and e by way of example in normal operation of the lighting system. Total reflection takes place in locations 32 and 34, i.e. once at a boundary surface of the collector 14 and once at a boundary surface of the separator 16.

The separators 16 ideally utilize the aperture distribution of the collector 14 in the embodiment shown. The curvatures of the light inlet surface 36 and the light outlet surface 38 of the separators each lie in the meridional focal plane. The collector in this direction has an aperture of approximately 15°. Perpendicular thereto, the aperture is only a few degrees, so that no imaging effect of the separators is necessary in this direction. It is possible in this manner to utilize total reflection at the longitudinal surfaces of the separators without interfering with the imaging of the high-contrast edges.

Since the high-power light sources in general use generate not only light in the visible range, but also in the UV range, it may be useful to provide UV-absorbing measures in the radiation path for reasons of radiation protection, but also in particular for prolonging the service life of the separators, which are advantageously manufactured from a synthetic resin such as, for example, polymethyl methacrylate and which usually are degraded by UV radiation.

Such measures may be provided in a wide variety of ways optimally adapted to the respective applications. Thus it is possible, for example, to arrange one or several UV filters between the light source 12 and the collector 14, or between the collector 14 and the separators 16. It may alternatively suffice to manufacture the collector from a UV-absorbing material such as, for example, glass. The light source 12, the light inlet and/or light outlet surface of the collector and/or the light inlet surfaces of the separators may be provided with a UV-absorbing layer. Since coatings on the light source tend to flake off owing to the high temperatures occurring during operation, coatings on the light outlet surface of the collector or the light inlet surfaces of the separators will usually be preferred.

The separators 16 have a curved light inlet surface 36 and a curved light outlet surface 38. Each separator 16 is a solid component, preferably made of synthetic resin with good optical waveguide properties such as, for example, polymethyl methacrylate. It is true that synthetic resins in comparison with glass have a low heat resistance, but the arrangement according to the invention has the major advantage that the light source and the separators can be thermally separated, so that the separators are exposed to a moderate heat generation only.

The lighting system according to the invention operates as follows, cf. FIGS. 4 and 5. Light is generated by the light source 12. The light is collected by the collector 14 and aimed at the separators 16 under formation of an interwoven radiation path. The collector here not only performs the function of light guiding, but it also reduces the aperture of the light radiated by the light source 12 and creates a certain light distribution at its outlet surface. Light beams arise at the edges of the light outlet surface without absorption, usually with the desired sharp light-dark transitions, for example for generating a passing beam in a motor vehicle.

The light beams are then guided into the separators 16 and towards the respective specially shaped light outlet surfaces by total reflection, at which surfaces they leave the separators and are superimposed so as to form the light beam of desired shape.

Numerous modifications and further developments are possible within the scope of the basic idea of the invention, for example relating to the shape and number of the separators. It is equally conceivable to form the collector and at least one of the separators as an integral unit. The efficiency may be further increased in that the light source is formed as an integral part of the collector, i.e. the lamp glass is shaped so as to form the collector. This renders it possible for the light-collecting element to surround the burner completely so as to catch more light from the arc. A lamp constructed as a collector is indeed more expensive than a conventional lamp, but since the further development of the gas discharge lamps is aimed at a considerably prolonged operational life, which renders an exchange of the lamp necessary very rarely only, the use of such lamps of more complicated construction would also seem to be commercially attractive.

What is claimed is:

1. A lighting system, in particular for motor vehicles, comprising at least one light source (12), preferably in the form of a high-power discharge lamp (HID lamp High Intensity Discharge lamp), in particular a low-voltage xenon lamp (MPXL: Micro Power Xenon Light), a collector (14) which surrounds the light source (12) at least partly for collecting and passing on the light generated by the light source (1) without absorption to at least one separator (16), and at least one separator (16) of optical waveguide material, each separator (16) comprising at least one specially shaped light outlet surface (26) for radiating the light, which was guided into the separator (16), as a light beam formed as a superposition of light beams radiated from each separator, said light beam having a clearly defined light-dark edge wherein said light beam moves from said at least one light source to exit said lighting system substantially in a solid medium.

2. A lighting system as claimed in claim 1, wherein the light source (12), the collector (14), and the separator (16) are arranged such that an interwoven radiation path is obtained.

3. A lighting system as claimed in claim 2, wherein the collector (14) and the separator (16) are arranged such that at least part of the image of the light source (12) generated by the collector (14) lies within the range of the entrance pupil of the separator (16).

4. A lighting system as claimed in any one of the claims 1 to 3, wherein the light source (12) is a light source with an aperture of less than 60°, preferably of between 20° and 40°.

5. A lighting system as claimed in any one of the claims 1 to 4, wherein the light outlet surface of the collector (14) is shaped such that the light beams issuing from the light outlet surface (96) of the collector (14) during normal operation of the lighting system have edges with sharp light-dark transitions.

6. A lighting system as claimed in any one of the claims 1 to 5, wherein the collector (14) is shaped such that the light collected thereby is guided to at least one light inlet surface (36) of the at least one separator (16) through reflection at the inner walls (28, 30) of the collector (14).

7. A lighting system as claimed in any one of the claims 1 to 6, wherein the light source (12) forms part of the collector (14).

8. A lighting system as claimed in any one of the claims 1 to 7, wherein several separators (16), preferably six to ten separators (16), are provided and are constructed such that a light beam of desired shape is obtained in normal operation of the lighting system through superposition of the light beams radiated by the separators (16).

9. A lighting system as claimed in any one of the claims 1 to 8, wherein the at least one separator (16) is constructed such that in the operational mounting position at least part of the light guided into the separator (16) via the collector (14) is directed to a light outlet surface (38) by means of total reflection (32, 34).

10. A lighting system as claimed in any one of the claims 1 to 9, wherein in the operational mounting position the length of the separator (16) or separators (16) and the collector (14) measured in the main radiation direction of the light radiated by the separator(s) (16) lies between 80 mm and 200 mm, and in the case of a lighting system for use in automobiles preferably between 80 mm and 120 mm.

11. A lighting system as claimed in any one of the claims 1 to 10, wherein in the operational mounting position the diameter of the separator or all separators (16) measured transversely to the main radiation direction of the light radiated by the separator(s) (16) lies between 60 mm and 200 mm, and in a lighting system for use in automobiles preferably between 60 mm and 100 mm.

* * * * *